7/1/86 OR 4,597,449

United States Patent [19]

Keeney

[11] Patent Number: 4,597,449

[45] Date of Patent: Jul. 1, 1986

[54] METHOD AND APPARATUS FOR PREVENTING FLUID RUNOVERS FROM A WELL

[76] Inventor: L. W. Keeney, 1001 ½ Hollywood, Farmington, N. Mex. 87401

[21] Appl. No.: 602,547

[22] Filed: Apr. 20, 1984

[51] Int. Cl.[4] ..... E21B 34/14

[52] U.S. Cl. ..... 166/373; 166/318; 166/325; 166/385; 166/386

[58] Field of Search ..... 166/99, 301, 317, 318, 166/325, 332, 373, 385, 386; 175/57, 208, 218; 137/68 R

[56] References Cited

U.S. PATENT DOCUMENTS

| | | | |
|---|---|---|---|
| 1,323,379 | 12/1919 | Rigby | 166/325 |
| 2,998,075 | 8/1961 | Clark, Jr. | 166/318 |
| 3,139,932 | 7/1964 | Johnson | 166/316 |
| 3,151,688 | 10/1964 | Young | 175/25 |
| 3,446,237 | 5/1969 | Haley | 137/463 |
| 3,446,283 | 5/1969 | Baumstinler | 166/99 |
| 3,599,713 | 8/1971 | Jenkins | 166/317 |
| 3,675,720 | 7/1972 | Sizen | 166/314 |
| 3,799,258 | 8/1974 | Tausch | 166/72 |
| 3,826,309 | 7/1974 | Tausch | 166/224.5 |
| 3,845,818 | 11/1974 | Deaton | 166/224.5 |
| 3,850,191 | 11/1974 | Brown | 137/271 |
| 3,865,141 | 2/1975 | Young | 137/629 |
| 3,951,338 | 4/1976 | Genna | 236/93 A |
| 3,955,623 | 5/1976 | Aumann | 166/0.6 |
| 4,077,473 | 3/1978 | Watkins | 166/323 |
| 4,088,298 | 5/1978 | Brown | 251/149.8 |
| 4,129,184 | 12/1978 | Parker | 166/315 |
| 4,154,303 | 5/1979 | Fournier | 166/317 |
| 4,216,830 | 8/1980 | Fredd | 166/319 |
| 4,252,197 | 2/1981 | Pringle | 166/322 |
| 4,315,553 | 2/1982 | Stallings | 175/207 |
| 4,364,407 | 12/1982 | Hilliard | 175/218 |
| 4,478,244 | 10/1984 | Garrett | 175/218 |

*Primary Examiner*—Stephen J. Novosad
*Assistant Examiner*—William P. Neuder
*Attorney, Agent, or Firm*—Cox & Smith Inc.

[57] ABSTRACT

A fluid restriction tool having a valve closure member which may be moved from a closed position by the passage of a wireline tool and which moves out of the way of a wireline tool upon removal thereof so that the valve closure member may return to its closed position.

17 Claims, 12 Drawing Figures

METHOD AND APPARATUS FOR PREVENTING FLUID RUNOVERS FROM A WELL

BACKGROUND OF THE INVENTION

This invention relates generally to a fluid restriction tool used primarily when fishing while running or lowering washover pipe in a well bore and an automatic blowout preventer. The fluid restriction tool prevents fluid runovers by controlling the flow of fluid from the washpipe into the work string (which is above the washpipe) through the washover pipe and permits the lowering of a wireline tool through the fluid restriction tool without hanging it up on the fluid restriction tool. The tool also functions as a safety valve to prevent well blowouts.

When a drill string or production string becomes stuck in a well bore it is common to perform fishing operations to retrieve the drilling string. A typical procedure for doing this is to run or lower washover pipe into a well bore. The washover pipe generally has a large inside diameter with a relatively close fit inside the well bore. As the washover pipe is lowered into the well, fluid in the well cannot displace fast enough around the outside of the washover pipe. Hence some of the fluid must be forced up through the inside diameter or passageway of the washover pipe. At the top of the washover pipe the inside diameter may be greatly reduced in the top bushing. When drilling fluid in the well is forced through the smaller inside diameter at the top of the washover pipe, the velocity of the fluid is generally greatly increased. This means that the fluid is traveling up faster than the pipe is being lowered. In this situation the fluid may run over the top of the work string before it reaches the point where the slips are set on the drilling platform. The slips are generally set when the drill pipe which is lowering the washpipe is two or three feet above the floor level of the drilling rig. In the situations where the drilling fluid has runover, it may runover as high as sixty (60) feet or more up in the derrick. Anytime the fluid runs over the top of the work string the runover creates hazardous working conditions, causes pollution and causes waste the of valuable fluids in the well. Additional waste results from the loss of drilling fluids, some of which are relatively expensive, and the rig down-time resulting from the occurrence of this hazardous condition.

In the past a method used to control drilling fluid runovers from wells has been to use what is commonly known in the oil field as a bleeder plug. A bleeder plug generally has a pin connection the same as the connection on the work string and usually the same inside diameter as the connection on the work string. Normally about one or two inches above the threaded portion of the bleeder plug a flat metal plate is welded. A half-inch valve is connected on the plate and a bail about twelve (12) inches high is welded to the bleeder plug which acts as a handle to chain the plug to the hook just below the traveling blocks.

The bleeder plug only partly controls the washover because the bleeder plug generally cannot be always used with running drill collars. Drill collars generally have to be handled with what is commonly known in the oil field as a handling sub or a lift nubbin which has no connection for a bleeder plug. Drill collars generally have a relatively large outside diameter and a fairly small inside diameter. This may cause a great deal of displacement of drilling fluid as the drill collars are lowered into the well containing the drilling fluid. The drill collars are placed in the washover string above the jars and bumper jars which are fishing tools. This is near the top of the washover pipe where they are usually screwed into a connection about a couple of feet above the washover pipe. The drill collars are generally about thirty (30) feet long.

Another method used in the past to prevent runover was to lower the washover pipe and drill collars very slowly. This is time consuming and as with most drilling may be very costly. The driller does not know how slowly to lower the drill collars and often a driller will get impatient and go too fast and in turn this forces the fluid over the top of the work string. When this occurs everyone on the floor of the drilling rig may be drenched with drilling fluid in addition to the loss of the fluid and the mess which occurs. Some of the drilling fluids are dangerous to the eyes and skin and some workers will not work under these conditions. Since the bleeder plug is chained to the hook this is dangerous to everyone on the rig floor because in the past some of these plugs have fallen from several feet up in the derrick for one reason or other when the chain came untied or the bail breaks. Also bleeding the fluid into the work string as it is being lowered keeps a lot of hydrostatic pressure off the formation and in turn is not as likely to break the formation down and lose fluid in the well bore. When fluid is lost in a well bore you lessen the hydrostatic pressure in the well bore. If there is any kind of high pressure zone of water, gas or oil, it is very likely the well will blow out.

With a bleeder plug very little fluid enters the bore of the work string, drill pipe or tubing since the bleeder plug has trapped air in the work string that is being lowered in the well bore, in turn this creates more hydrostatic pressure on the formation which is very bad.

Applicant is aware of the following U.S. patents:

3,151,688, Young; 3,446,237, Haley; 3,675,720, Sizer; 3,799,258, Tausch; 3,826,309, Tausch; 3,845,818, Deaton; 3,850,191, Brown; 3,865,141, Young; 3,951,338, Genna; 3,955,623, Aumann; 4,077,473, Watkins; 4,088,298, Brown; 4,129,184, Parker; 4,154,303, Fournier; 4,216,830, Fredd; 4,252,197, Pringle.

It is an object of the present invention to overcome the problems present in the prior art and provide an apparatus and method which allows workmen to safely lower a washover pipe into a well bore. It is another object of the invention to provide an apparatus and method which will prevent the loss of drilling fluid while lowering washover pipe in a well bore. It is another object of the invention to provide an apparatus and method which will protect workmen on the drilling rig floor while lowering washover pipe in a well bore. It is another object of the present invention to provide an apparatus and method which prevents fluid runover while permitting the insertion and withdrawal of wireline tools. It is another object of the invention to provide an apparatus and method which prevents runover of drilling fluid while permitting inserting and withdrawing a fishing tool therethrough to retrieve stuck pipe. Another object of the invention is to keep more hydrostatic pressure off the formation. It is another object of the invention to provide a safety valve means which allows insertion and retrieval of wireline tools. Other objects of the invention will be apparent from the following detailed disclosure.

SUMMARY OF THE INVENTION

The invention relates to a fluid restriction apparatus and method for running a fishing string into a bore hole containing drilling fluid and for passing a wireline tool therethrough. The apparatus includes a fluid restriction means for controlling the flow of fluid through the fishing string to prevent overflow. The fluid restriction apparatus allows passing of a wireline tool therethrough and also permits retrieval of the wireline tool through the fishing string. The fluid restriction apparatus includes a valve means having a bleeder means to allow fluid to pass from the inside of the fishing string at a controlled rate as the fishing string is lowered into the bore hole containing drilling fluid. The valve means permits the downward movement of a wireline tool through the fluid restriction apparatus and allows removal of the wireline tool through the fluid restriction apparatus. The valve means automatically moves to its position restricting or blocking the passage of drilling fluid to prevent uncontrolled runover or flowing of the drilling fluid through the fishing string.

BRIEF DESCRIPTION OF THE PREFERRED EMBODIMENT

Figure 1:
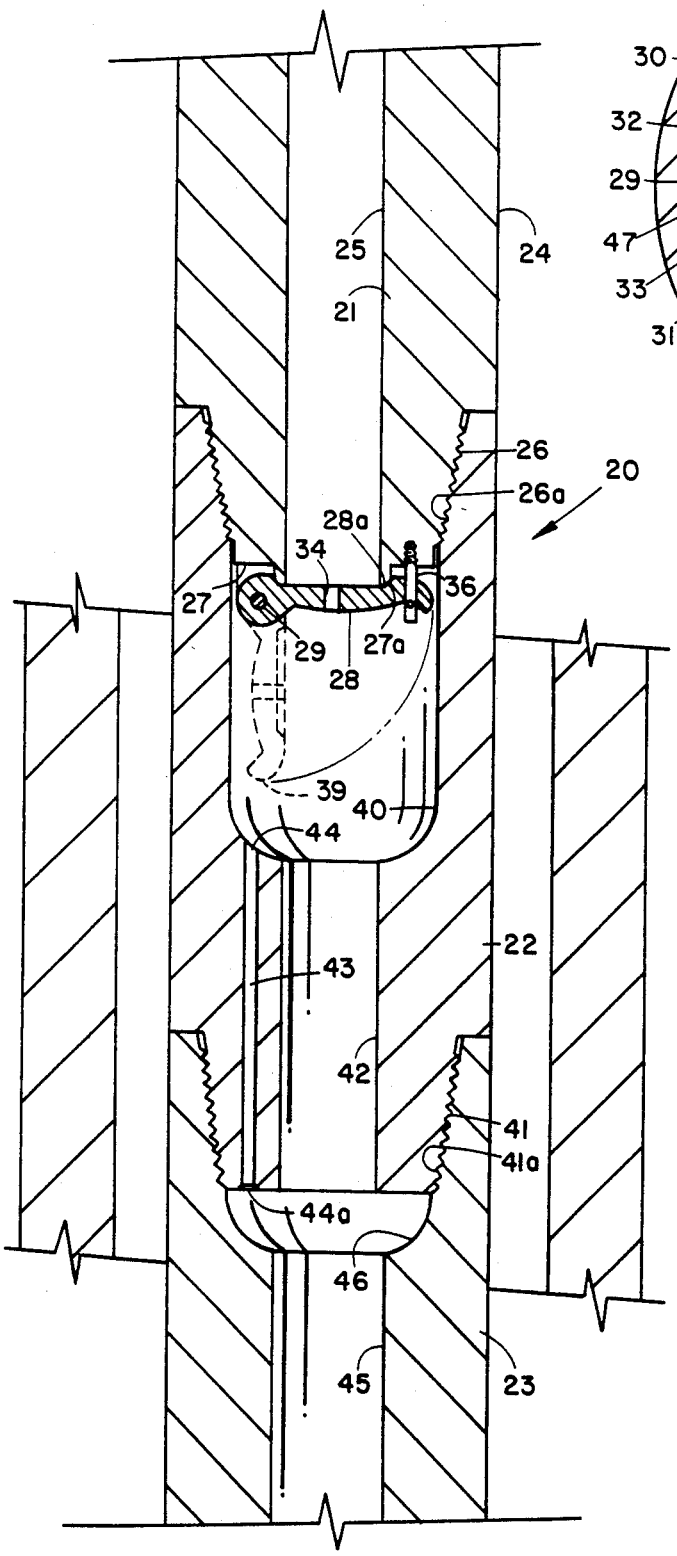
FIG. 1 shows a cross sectional view of a first embodiment of the invention.

Referring to FIG. 1 of the invention there is shown a fluid restriction tool 20. Fluid restriction tool 20 includes an upper section 21 and a middle section 22, which is attached to a lower section or workstring 23. The bottom section 23 includes a conventional connector means such as a box joint for connecting in the washover pipe and running string. The upper section 21 is generally cylindrical in cross section and includes a cylindrical outer surface 24 and a cylindrical inner surface which forms a passageway 25 through the upper section. The passageway 25 is of sufficient diameter to permit passing of a standard wireline tool. The upper section 21 terminates in a pin connection 26 for releasably securing the upper section with a box connection at the upper end of the middle section 22. Pivotably attached to the lower end portion 27 of the upper section is a valve closure member 28.

The valve closure member 28 is pivotably connected about a pivot pin 29 which extends through lugs 30 and 31 which form a portion of the lower end portion 27. Lugs 32 and 33 are integrally formed with the valve closure member 28 and pivotably receive the pivot pin 29 for rotation of the valve closure member from its broken line position as shown in FIG. 1 to the closed position shown in solid lines about pivot pin 29. The valve closure member 28 includes a seat portion 28*a* which forms a seal with the seat portion 27*a* on the lower end portion 27.

The valve closure member 28 includes a passageway or bore 34 extending therethrough. The bore 34 is sized to allow fluid to pass therethrough as the fishing string in which the fluid restriction tool 20 is connected is lowered into a well bore. It also allows the controlled bleed-off of drilling fluid. As will be apparent a reduced and controlled amount of fluid can pass through the bore 34 thereby keeping fluid from running up out of the work string.

Figure 3:
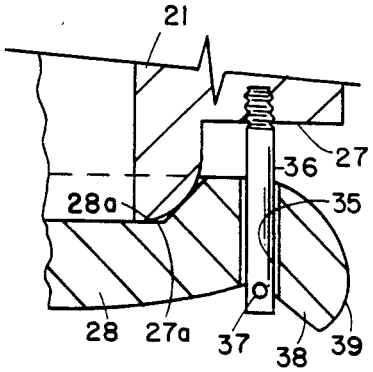
FIG. 3 is an enlarged partial view taken from FIG. 1 showing the shear pin which maintains the valve in its closed position.

The valve closure member 28 may also include an opening or aperture 35 at one end. The aperture 35 receives a pin 36. The aperture 35 is slightly larger than pin 36 to permit pivoting of the valve closure member 28 to its open position. A horizontal shear pin 37 may be used to maintain the valve closure member 28 in its closed position as shown in FIGS. 1 and 3. As explained more fully later, the shear pin is broken by pump pressure against the valve closure member 28. The end portion 38 of the valve closure member includes a curved surface 39 for a purpose more fully explained hereinafter.

Figure 2:
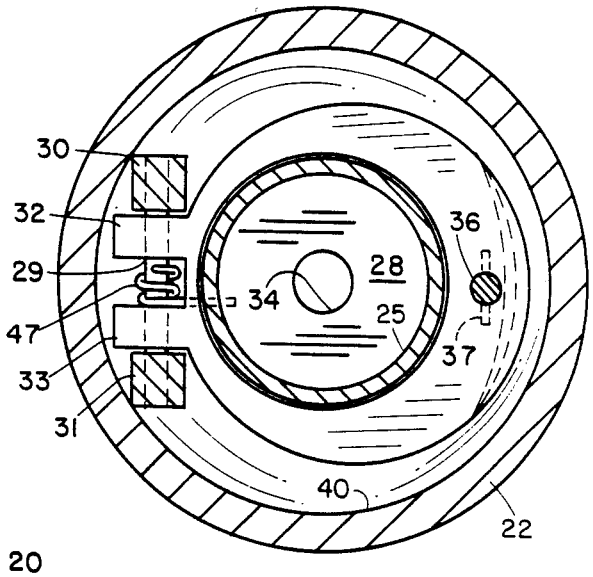
FIG. 2 shows a cross sectional view of another embodiment of the invention with a spring to maintain the valve in its closed position.

The middle section 22 includes an enlarged portion 40 which permits swinging movement of the valve closure member 28 from its closed position as shown in FIG. 1 in solid lines to its open position as shown in FIG. 2 in broken lines out of the way of the passageway for insertion and retrieval of wireline tools. As shown in FIG. 1 the lower portion of the middle section 22 includes a pin connector 41 which releasably secures the middle section to a box connection 41*a* of the work string 23. The middle section 22 includes a cylindrical passageway 42 having substantially the same diameter as the cylindrical passageway 25. A second bore or passageway 43 is provided in the middle section 22. As the fishing string is lowered into the well bore and as fluid rises in the bore of the fishing string a portion of the drilling fluid will be directed through the passageway 43. The upper opening 44 of the passageway 43 is positioned to direct the stream of drilling fluid at the pivoting valve closure member 28 to force it to its closed position as shown in FIG. 1.

The work string 23 includes a passageway 45 through which the fluid passes. The work string 23 also includes an enlarged concave portion 46 which permits fluid to pass through the lower opening 44*a* of the passageway 43 and out the upper opening 44.

The valve closure member 28 may also have a coiled spring 47 as shown in FIG. 2 which biases the valve closure member to its closed position. The spring 47 could be used in place of the passage 43 to close the valve closure member.

Figure 4A:
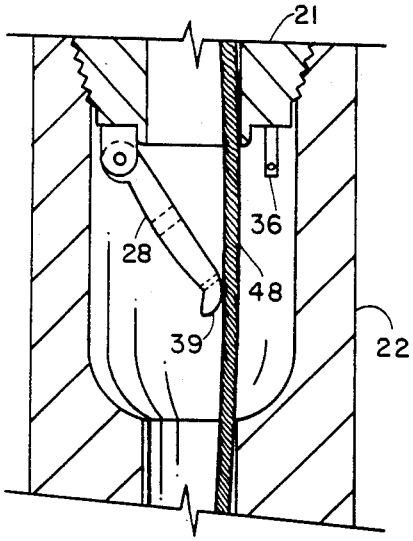
FIG. 4*a* shows a wire line having been lowered through the fluid restriction apparatus.
Figure 4B:
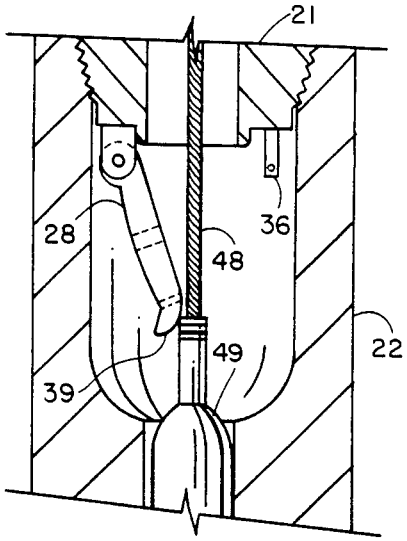
FIG. 4*b* shows the wire line tool approaching the fluid restriction apparatus.
Figure 4C:
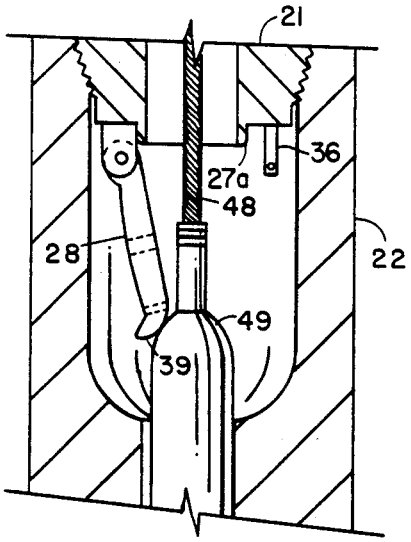
FIG. 4*c* shows the wire line tool moving the fluid restriction apparatus out of the way for removal of the wire line tool.

In operation, when a work string which is also referred to as a fishing string or washover pipe is lowered into the well, fluid is forced upwardly within the passageway in the work string faster than the string is lowered into the well. This is caused by the displacement of the fluid by the mass of the pipe making up the work string. The valve closure member 28 may be held in its closed position as shown in FIG. 1 by the shear pin 37 or the spring as shown in FIG. 2. As the work string is lowered through the bore, fluid will escape through the bleeder hole or bore 34 until the work string is full of fluid. The fluid then is slowly bled through the bleeder hole 34. When it is desired to lower a wireline tool through the work string, the wireline tool engages the upper surface of the valve closure member 28 (when sufficient pressure was applied to the upper surface the shear pin 37 will be broken) which allows the valve closure member 28 to be pivoted downwardly as shown in FIG. 1. This allows passage of a conventional wireline tool through the work string without removal of the fluid restriction tool 20. After the wireline tool is lowered to perform its function it is then removed by pulling it out of the working string. Referring to FIG. 4*a* there is shown a wire line 48 which has been lowered through the fluid restriction tool 20. As will be apparent, the valve closure member 28 may be biased upwardly by the coil spring 47 toward its closed position. When the wire line tool 49 approaches the valve closure member 28 as shown in FIG. 4*b*, the upper end of the wire line tool 49 engages the curved or cammning surface 39 to move the valve closure member 28 towards its open position to allow passage of the wire line tool 49 as further shown in FIG. 4*c*. Accordingly, the wire line tool 49 may be removed from the working string after it has performed its function. This is made possible by the radius of curvature of the curved surface 39 which acts as a camming surface to automatically move the valve closure member out of the way of the wireline tool. The curved free end of the valve closure member 28 prevents it from jamming with the wire line tool as the wire line tool is raised out of the working string. In the case of the coil spring 47 the valve closure member 28 is returned to its closed position as shown in FIG. 2.

Figure 5:
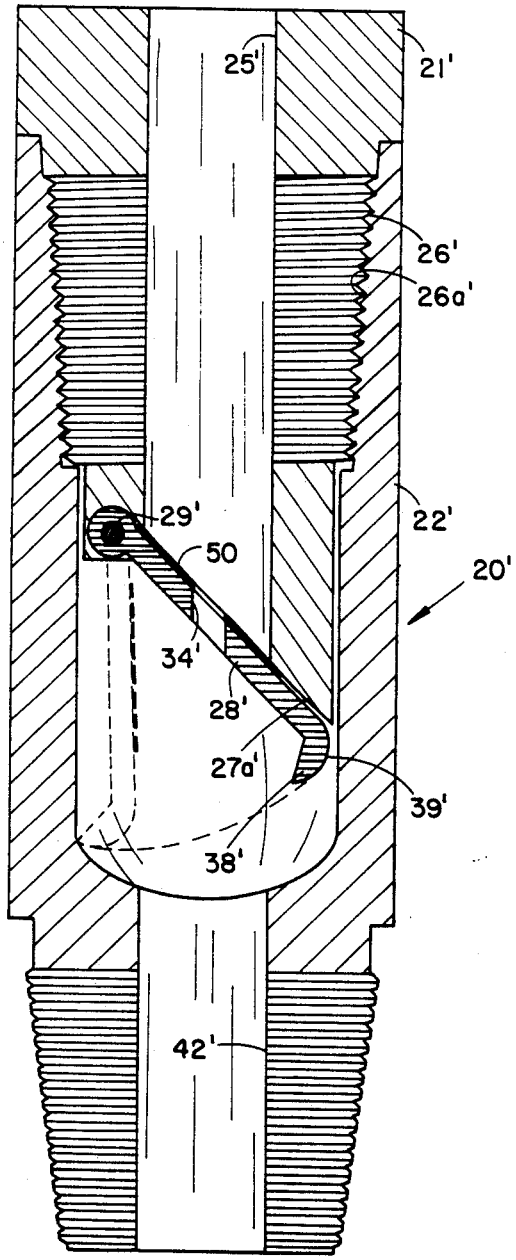
FIG. 5 shows a cross sectional view of another embodiment of the invention.

Referring to FIG. 5 of the invention there is shown another embodiment of the invention. Similar reference numerals are used on components of the embodiment shown in FIGS. 5, 6 and 7 which correspond to the components of the embodiments shown in FIGS. 1, 2, 3, 4*a*, 4*b*, and 4*c*.

The fluid restriction tool 20′ as shown in FIG. 5 includes an upper section 21′. The upper section 21′ includes a pin connection 26′ which is received in a box connection 26″ in the middle section 22′. A passageway 25′ allows the flow of fluid through the upper section 21′. A valve closure member 28′ is pivotably connected about a pivot point 29′ as shown in FIG. 2. The middle section 22′ includes an enlarged portion 22″ for allowing the valve closure member 28′ to pivot from its closed position as shown in FIG. 5 to its open position shown in broken lines in FIG. 5 for unblocking passageway 25′. The end portion 38′ of the valve closure member includes a curved camming surface 39′ which functions in the same manner as the camming surface 39 in the other embodiments. As will be apparent a coil spring which is identical to the coil spring 47 maintains the valve closure member 28′ in its closed position as shown in FIG. 5.

Figure 6:
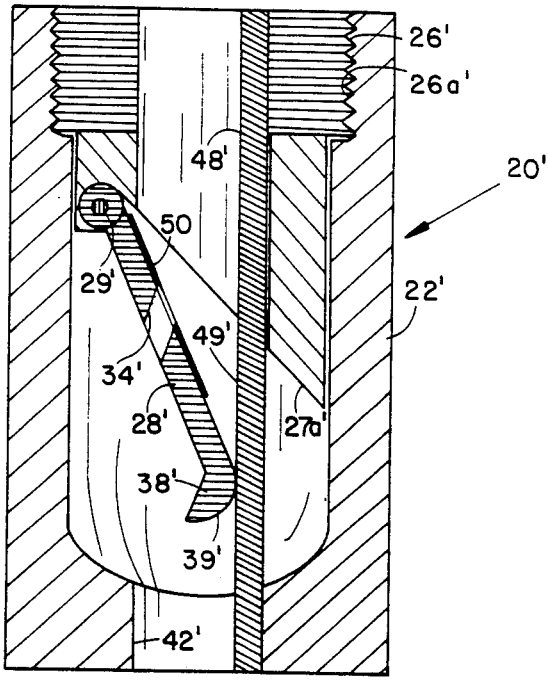
FIG. 6 shows a wire line tool having been moved through the fluid restriction apparatus of FIG. 5 by biasing the valve to its open position.
Figure 7:
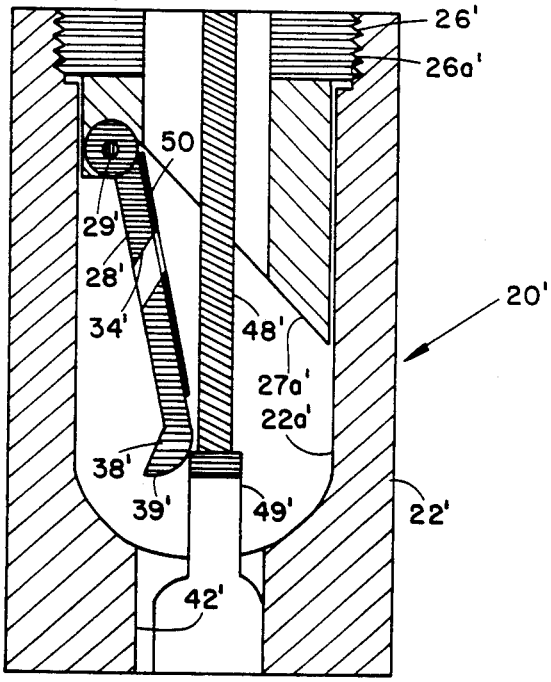
FIG. 7 shows a wire line tool engaging the valve means of the fluid restriction apparatus of FIG. 5 to move it out of the passageway so the wire line tool can be removed.

The valve closure member 28′ is positioned at an acute angle to the horizontal as shown in FIG. 5 to facilitate movement of a wireline tool 49′ therethrough and removal of the fishing tool 49′. The passageway or bore 34′ allows bleeding of air and fluid through the fluid restriction tool 20′ as does the bore 34 in the embodiment shown in FIGS. 1, 2, and 3. A seal member 50 which may be rubber or the like is positioned on the upper surface of the valve closure member 28′ to engage the sealing surface 27*a*′ to effect a seal. The pressure of the fluid and the coil spring maintains the seal so that fluid passing through the fluid restriction tool is restricted through the bore 34′. The angle at which the valve closure member 28′ is positioned is to facilitate insertion and removal of a wire line 48′ and a wire line tool 49′. As shown in FIGS. 5, 6, and 7 this angle is approximately 45 degrees to facilitate lowering of the wire line tool 49′ through the fluid restriction tool 20′ and removal of the wire line tool 49′. The engagement of the wire line tool 49′ physically moves the valve closure member 28′ out of the way blocking the passageway 25′ so that the wire line tool 49′ may move through the passageways 25′ and 42′ and through the working string.

Figure 8:
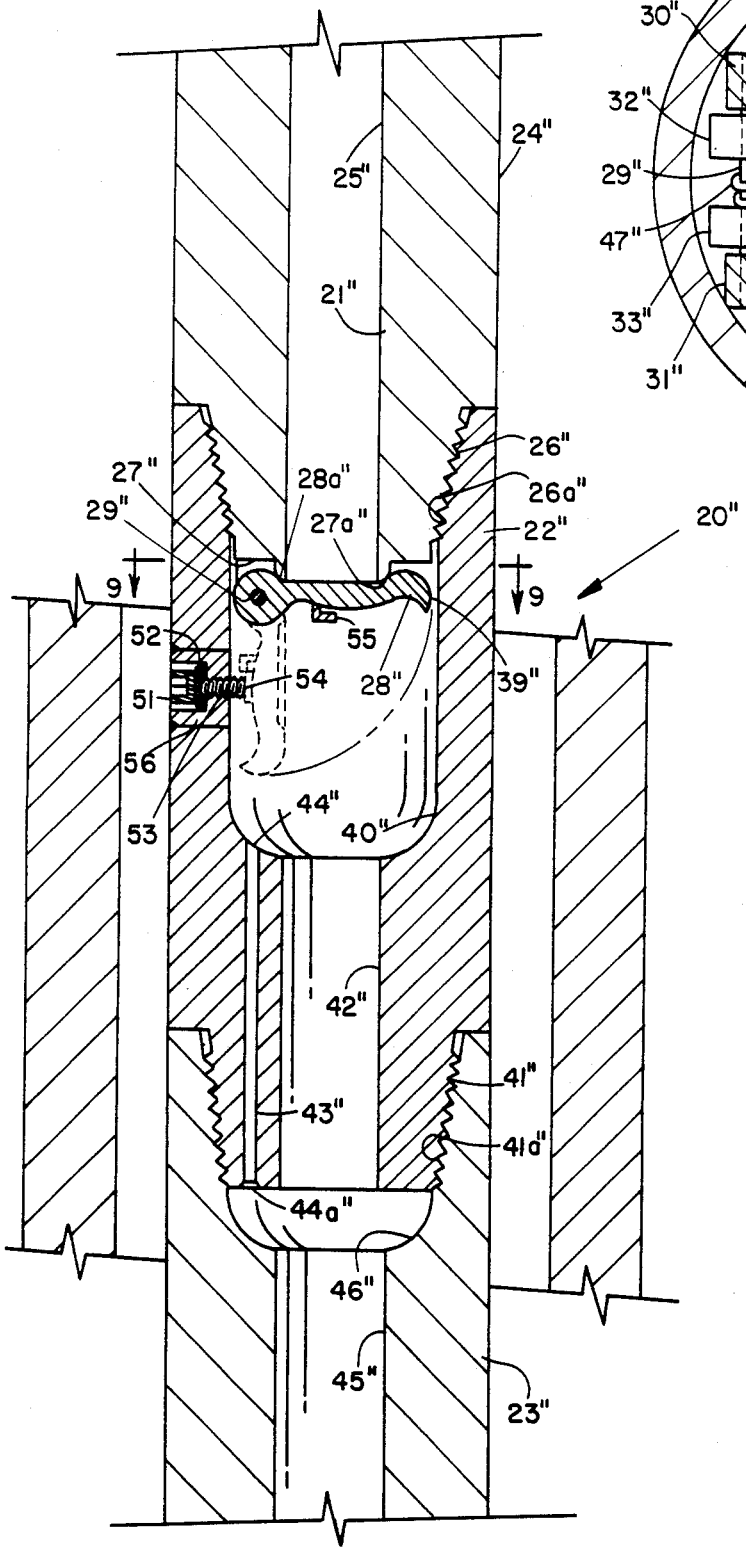
FIG. 8 shows a cross sectional view of another embodiment of the invention.

Referring to FIG. 8 of the invention, there is shown another fluid restriction tool 20″. Fluid restriction tool 22″, which is attached to a lower section or work string 23″. The upper section 21″ includes a conventional connector means such as a box joint for connecting in a running string. The upper section 21″ is generally cylindrical in cross section and includes a cylindrical outer surface 24″ and a cylindrical inner surface which forms a passageway 25″ through the upper section. The passageway 25″ is of sufficient diameter to permit passage of a standard wireline tool. The upper section 21″ terminates in a pin connection 26″ for releasably securing the upper section with a box connection at the upper end of the middle section 22″. Pivotably attached to the lower end portion 27″ of the upper section is a valve closure member 28″.

The valve closure member 28″ is pivotably connected about a pivot pin 29″ which extends through lugs 30″ and 31″ (FIG. 9) which form a portion of the lower end portion 27″. Lugs 32′ and 33′ (FIG. 9) are integrally formed with a valve closure member 28″ and pivotably receive the pivot pin 29″ for rotation of the valve closure member from its broken line portion shown in FIG. 8 to the closed portion shown in solid lines about pivot pin 29″. The valve closure member 28″ includes a seat portion 28*a*″ which forms a seal with the seat portion 27*a*″ on the lower end portion 27″.

The valve closure member 28″ does not include a passageway or bore such as bore 34 as shown in FIG. 1 passing therethrough. Accordingly, the valve disclosed in FIGS. 8–10 does not allow the controlled bleed-off of fluid. Rather the valves disclosed in FIGS. 8–10 act as a blowout preventer and function similarly to the valves shown in FIGS. 1–7.

The middle section 22″ includes an enlarged portion 40″ which permits swinging movement of the valve closure member 28″ from its closed position as shown in FIG. 8 in solid lines to its open position shown in broken lines out of the way of the passageway for insertion and retrieval of tools. As shown in FIG. 8, the lower portion of the middle section 22″ includes a pin connector 41″ which releasably secures the middle section to a box connection 41a" of the lower section 23". The middle section 22" includes a cylindrical passageway 42" having substantially the same diameter as the cylindrical passageway 25". A second bore or passageway 43" may be provided in the middle section 22". As a work string is lowered into the well bore, fluid will be prevented from rising in the bore of the fishing string by the closed valve closure member 28".

The lower section 23" includes a passageway 45" through which the drilling fluid in the well bore passes. The lower section 23" also includes an enlarged concave portion 46" which permits drilling fluid to pass through the lower opening 44a" of the passageway 43" and out the upper opening 44".

Figure 9:
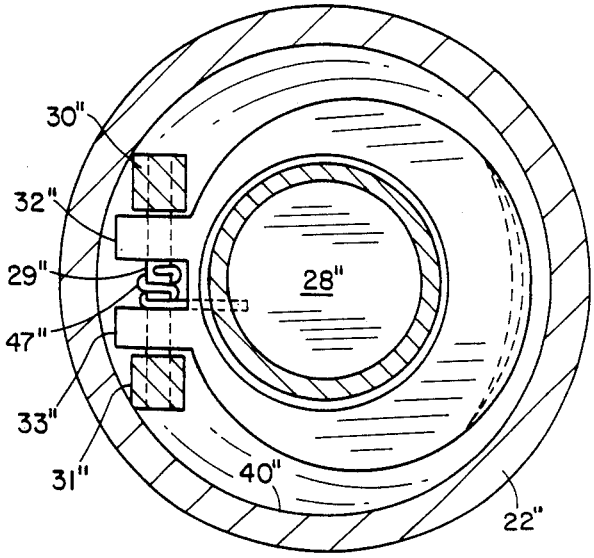
FIG. 9 is a cross section taken along line 8—8 in FIG. 8.
Figure 10:
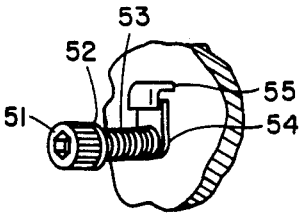
FIG. 10 is an enlarged partial view taken from FIG. 8 showing the catch means for maintaining the valve in its open position.

The valve closure member 28" also has a coiled spring 47" as shown in FIG. 9 which biases the valve closure member to its closed position. The valve closure member may be retained in its open position by a catch means shown in FIGS. 8 and 10. The catch means includes a catch member 55 secured to the valve closure member 28". A releasable catch supporting member 56 is mounted in the middle section 22". A hexhead bolt 51" having threaded portion 53" is threadably mounted in the releasable catch supporting member 56. An O-ring 52 provides a seal. Secured to the end of the hexhead bolt 51 is a second catch member 54 which engages the catch member 55 as shown in FIG. 10. The valve closure member 28" may be maintained in its open position as shown in FIG. 8 by retaining the second catch member 54 in its position as shown in FIG. 10. In order to release the second catch member 54, a hexhead wrench is inserted in the head portion of the hexhead bolt 51 so that it may be rotated. Only a slight rotation is necessary to release the valve closure member so that it moves to its position as shown in FIG. 8. The O-ring 52 maintains a seal so that fluid does not leak past the threaded portion 53. The valve closure member 28" is normally maintained in its open position and is only released when it is desired to act as a blowout preventer. The passageway 43" also facilitates biasing of the valve closure member 28" to its closed position by directing fluid through the passageway 44".

When the second cath member 54 is released from the catch member 55 the valve member 28' is moved to its closed position. When it is desired to lower a wireline tool through the working string, the wireline tool engages the upper surface of the valve closure member 28" and when sufficient force is applied thereto, the valve closure member 28" is pivoted downwardly as shown in broken lines in FIG. 8. This allows passage of a conventional wireline tool through the work string without removal of the fluid restriction tool 20". After the wireline tool is lowered to perform its function, it is then removed by pulling it out. As will be apparent, the valve closure member 28" is biased upwardly by the coil spring 47" towards its closed position. When a wireline tool approaches the valve closure member 28" the upper end of the wireline tool engages the curved or camming surface 39" to move the valve closure member 28" towards it open position to allow passage of the wireline tool. Accordingly, a wireline tool may be removed from the working string after it has performed its function. This is made possible by the radius of curvature of the curved surface 39 which acts as a camming surface to automatically move the valve closure member out of the way of a wireline tool. The curved free end of the valve closure member 28" prevents it from jamming with a wireline tool as the wireline tool is raised out of the working string. The coil spring 47" returns the valve closure member 28" to its closed position as shown in FIGS. 8 and 9 after the wireline is removed.

Although the invention has been described in conjunction with the foregoing specific embodiment, many alternatives, variations and modifications will be apparent to those of ordinary skill in the art. Those alternatives and modifications are intended to fall within the spirit and scope of the appended claims.

I claim:

1. An apparatus for preventing the uncontrolled passage of fluids through a well comprising:

a housing having a passageway therethrough;

a valve in said passageway having a passageway therethrough of sufficient size to permit the passage of a wireline tool therethrough and including a valve closure means operable in a first position to close said valve to prevent the passage of fluid and in a second position to allow the passage of fluid and a wireline tool; and means on said valve closure means operable to bias said valve closure means towards said second position when engaged by said wireline tool being withdrawn from the well through the passageway in said valve.

2. The apparatus as set forth in claim 1 wherein:

the valve closure means includes a clapper type valve pivotably mounted to the housing.

3. The apparatus set forth in claim 1 wherein:

the valve closure means includes a floating member having a density such that it will float in drilling fluid to at least partially block the passageway upon the movement of drilling fluid upwardly through the fishing string.

4. The apparatus as set forth in claim 1 wherein:

the valve closure means includes a shear pin to normally maintain the valve closure means in the first position.

5. The apparatus as set forth in 1 wherein:

the valve closure means is positioned at an acute angle to the horizontal to facilitate passage of a wireline tool through the valve and removal of the wireline tool through the valve.

6. The apparatus as set forth in claim 1 wherein:

the valve closure means includes a bore having a predetermined size to permit the controlled passing of fluid through the working string.

7. The apparatus as set forth in claim 1 wherein:

said valve closure member biasing means comprises a passageway for directing fluid against the valve closure member thereby forcing the valve closure member toward said first position.

8. The apparatus as set forth in claim 1 wherein:

said means operable to bias said valve closure member toward said second position when engaged by a wireline tool includes a camming surface which engages the wireline tool when the wireline tool is withdrawn from the well through the passageway in the valve.

9. The apparatus as set forth in claim 1 wherein:

said means for biasing said valve closure member toward said first position comprises a spring.

10. The apparatus as set forth in claim 1 wherein:

said apparatus additionally comprises means operable to allow some movement of fluid through said valve closure member when said valve closure member is in said first position.

11. The apparatus as set forth in claim 10 wherein:

said means operable to allow some movement of fluid through said valve closure member when said valve closure member is in said first position comprises a bore through said valve closure member.

12. A fluid restriction apparatus for prevention of fluid overruns from a well and for passing a wireline tool therethrough comprising:

a housing having a passageway therethrough and means for engaging a running string;

a valve closure member;

means operable to bias said valve closure member to a first position sealing the passageway through said housing, thereby preventing the uncontrolled overrun of fluids from the well;

means operable to allow the movement of fluid past said valve closure member in said first position at a controlled rate;

said valve closure member having means thereon for engaging a wireline tool operable to bias said valve closure member to a second open position for upward passage of the wireline tool.

13. The apparatus as set forth in claim 12 wherein:

said means operable to allow the movement of fluid past said valve closure member comprises a bore through said valve closure member.

14. The apparatus as set forth in claim 12 wherein:

said means operable to bias said valve closure member to said first position comprises a spring.

15. The apparatus as set forth in claim 12 wherein:

said means operable to bias said valve closure members to said first position comprises a second passageway through said housing operable to direct an upward flow of fluid against said valve closure member.

16. Apparatus for prevention of fluid overruns from a well comprising:

a housing having a passageway therethrough of sufficient size to permit the passage of fluid and a wireline tool;

a valve closure member mounted in the passageway;

means biasing said valve closure member towards a first position closing the passageway;

means engaging said valve closure member to releasably hold said valve closure member in a second open position; and means on said valve closure member for engaging said wireline tool as the wireline tool is moved upwardly through the passageway operable to bias said valve closure member toward said second open position.

17. A method for preventing fluid overrun when running washover pipe comprising:

running washover pipe into a well bore;

allowing fluid to flow upwardly through said well bore at a controlled rate;

opening a valve closure member in response to movement of a wireline tool into said well bore; and moving said valve closure member out of the passageway to allow upward movement of said wireline tool out of said well bore.

* * * * *